US005097608A

United States Patent [19]

Theurer

[11] Patent Number: 5,097,608

[45] Date of Patent: Mar. 24, 1992

[54] BALLAST REGULATOR

[75] Inventor: Josef Theurer, Vienna, Austria

[73] Assignee: Franz Plasser Bahnbaumaschinen-Industriegesellschaft m.b.H., Vienna, Austria

[21] Appl. No.: 438,941

[22] Filed: Nov. 16, 1989

Related U.S. Application Data

[63] Continuation of Ser. No. 307,840, Feb. 7, 1989, abandoned.

[30] Foreign Application Priority Data

Aug. 31, 1988 [EP] European Pat. Off. ..... 88890218.6

[51] Int. Cl.[5] ..... E01B 27/02

[52] U.S. Cl. ..... 37/104; 104/279

[58] Field of Search ..... 37/104, 105, 106, 107; 104/2, 279

[56] References Cited

U.S. PATENT DOCUMENTS 3,651,587 3/1972 Plasser et al. ..... 37/105
3,877,160 4/1975 Plasser et al. ..... 37/104
4,249,325 2/1981 Theurer ..... 37/104
4,282,663 8/1981 Theurer ..... 37/104

FOREIGN PATENT DOCUMENTS 0164160 12/1985 European Pat. Off. .
0228109 7/1987 European Pat. Off. .
1040104 8/1965 United Kingdom .
1006639 10/1965 United Kingdom .

*Primary Examiner*—David H. Corbin
*Assistant Examiner*—Arlen L. Olsen
*Attorney, Agent, or Firm*—Collard, Roe & Galgano

[57] ABSTRACT

A mobile ballast plow comprises a machine frame and a ballast planing plow vertically adjustably mounted on the machine frame and extending from shoulder to shoulder. The ballast planing plow includes central plow elements extending over the center track portion, and a ballast conveying device associated with the central plow elements and arranged in the center track portion. The ballast conveying device consists of at least one vertically adjustable broom rotatable about an axis extending in the direction of the track, the broom having radially extending flexible ballast sweeping elements, and respective drives for vertically adjusting and rotating the broom.

14 Claims, 2 Drawing Sheets

Fig. 3
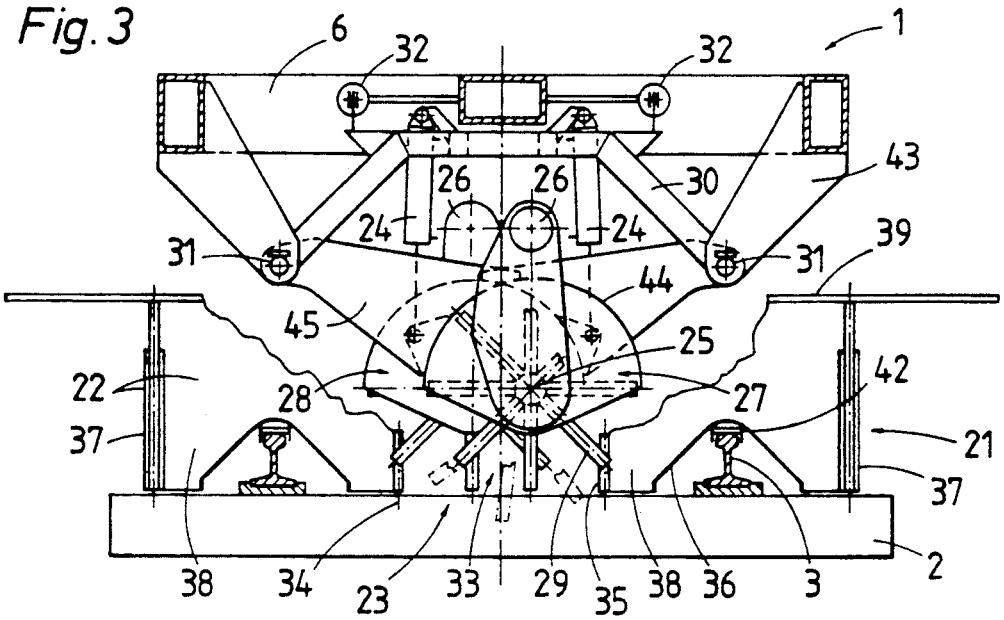
Fig. 4
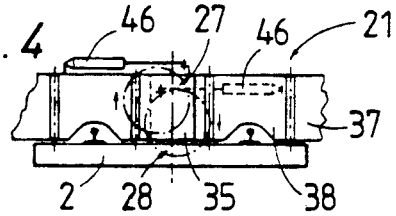
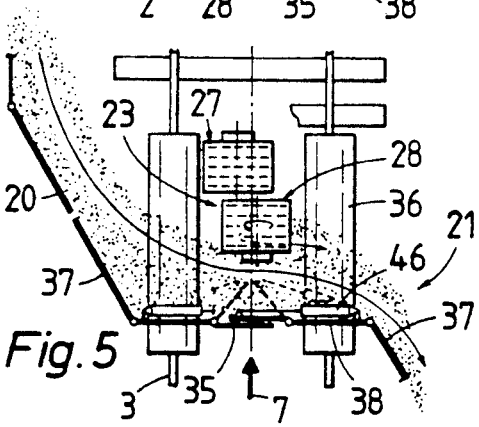
Fig. 5
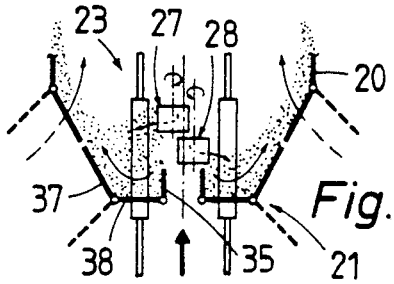
Fig. 7
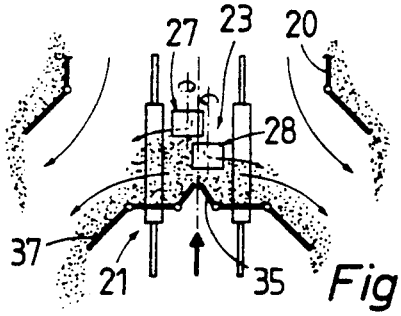
Fig. 8
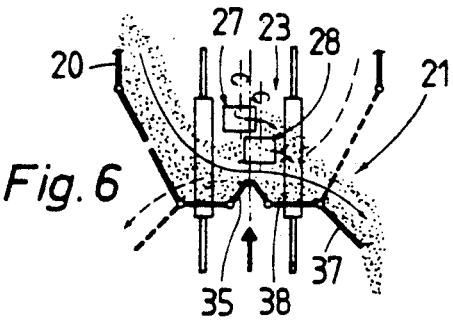
Fig. 6
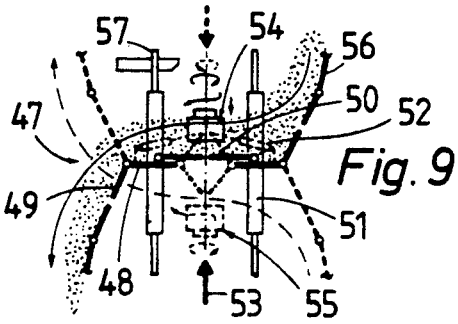
Fig. 9

BALLAST REGULATOR

CROSS-REFERENCE TO RELATED APPLICATION

This is a continuation of my copending U.S. patent application Ser. No. 307,840, filed Feb. 7, 1989, now abandoned.

BACKGROUND OF THE INVENTION

1. Field of the Invention

The present invention relates to improvements in a mobile ballast regulator machine for distributing and shaping ballast of a ballast bed supporting a track consisting of two rails fastened to ties, the two track rails defining a center portion of the track therebetween and respective shoulders supporting opposite ends of the ties at field sides of the rails, which comprises a machine frame supported by undercarriages for mobility along the track in an operating direction, a drive for moving the machine frame in this direction, and operator's cab on the machine frame, a ballast planing plow arrangement vertically adjustably mounted on the machine frame and extending from shoulder to shoulder, the ballast planing plow arrangement including central plow elements extending over the center track portion, and a power drive for vertically adjusting the ballast planing plow arrangement.

2. Description of the Prior Art

A ballast regulator of this type has been disclosed in U.S. Pat. No. 3,651,587, dated Mar. 28, 1972. The vertically adjustable ballast planing plow arrangement of this machine extends across the track from shoulder to shoulder and is comprised essentially of two ballast plows respectively associated with each rail. Each ballast plow is longitudinally displaceable along a guide on the machine frame so that the plows with their operating elements may be individually adjusted at each rail. The ballast planing plow arrangement may be mounted on a self-propelled machine frame carrying an operator's cab or on the machine frame of a ballast cleaning machine, a tie tamper or a crib tamper, either between the undercarriages of the machine frame or cantilevered to a front end thereof, and the operating elements of the ballast planing plow arrangement are adjustable into a great variety of operating positions, all extending across the track bed. Such ballast regulators have been very successfully used in track maintenance and rehabilitation work.

U.S. Pat. No. 3,877,160, dated Apr. 15, 1975, discloses another such ballast regulator whose ballast planing plow arrangement is vertically adjustably mounted on a self-propelled machine between the undercarriages thereof below an operator's cab. The ballast planing plow arrangement has plowshares forming a V-configuration, a tunnel-shaped element covering each rail and being affixed to a respective transverse plowshare to which a side plowshare is connected and extends to a respective track shoulder. Three plowshares pivotal about a vertical axis are arranged in the center portion of the track between the transverse plowshares, two of which form the apex of the V-configuration and the third one projecting forwardly in the operating direction. Additional transverse and side plowshares are associated with each tunnel-shaped rail covering element to form a double-V to guide ballast inwardly toward the pivotal center plowshares. Shoulder plows on each side of the machine frame precede the ballast planing plow arrangement in the operating direction, and a trailing, transversely arranged ballast broom with flexible sweeping hoses is rotatable to convey any ballast on the ties to an elevator which conveys such ballast to a storage container on the machine frame. This ballast regulator has also been very successfully used in commercial operations and enables ballast to be readily distributed to any desired ballast bed area. Similar machines have been disclosed in U.S. Pat. Nos. 4,249,325, dated Feb. 10, 1981, and 4,282,663, dated Aug. 11, 1981.

British patent No. 1,006,639, published Oct. 6, 1965, discloses a self-propelled machine for clearing ballast from the center of the track toward the two ballast bed strips on which the track rails are supported to avoid "riding" of the ties on accumulations of ballast in the track center. For this purpose, two ballast brooms with radially projecting flexible hoses are mounted on a vertically adjustable carrier, the brooms being rotatable in opposite directions about axes extending in the direction of the track to convey ballast from the center laterally outwardly. The brooms are transversely spaced from each other and slightly staggered in the direction of the track.

British patent No. 1,040,104, published Aug. 24, 1965, discloses a small track car mounting a crib ballast compactor between its undercarriages and preceded by ballast brooms with radially projecting flexible hoses in the operating direction. The ballast brooms are mounted on a common, vertically adjustable carrier frame cantilevered to a front end of the car frame, one of the brooms being rotatable about an axis extending transversely to the track while two additional ballast brooms precede the transverse broom and are rotatable about axes extending in the direction of the track. This enables excess ballast to be swept from the center of the track towards the rails and, at the same time, any ballast lying on the ties to be swept into the adjacent cribs for subsequent compaction.

U.S. Pat. No. 4,742,628 discloses a mobile ballast regulator with a ballast planing plow arrangement vertically adjustably mounted on a machine frame between the undercarriages thereof and in front of an operator's cab. This arrangement comprises a respective tunnel-shaped element covering each rail, a respective transverse plowshare above each tunnel-shaped rail covering element and a side plowshare pivoted to each transverse plowshare. A vertically adjustable carrier frame is arranged centrally between the two transverse plowshares which are linked to the carrier frame for pivoting about a vertical axis, and a drive is connected to the transverse plowshares for pivoting the same. The gap between the two transverse plowshares is bridged in the center of the track by a ballast conveying drum with radially projecting iron vanes, and this drum is vertically adjustably mounted on the carrier frame and is rotatable about an axis extending in the direction of the track. This ballast planing plow arrangement, including the plowshares and the drum, extends from shoulder to shoulder and is designed to distribute ballast from an obliquely positioned half at one shoulder to the center of the track whence it is conveyed to the opposite shoulder by the rotating drum. Depending on the rotational speed of the drum, the ballast flow from one to the opposite shoulder may be unfavorably influenced. Furthermore, the drum vanes will prevent any ballast flow when the drum is not rotated. In addition, the rigidity of the drum vanes produce a milling effect causing considerable wear on the radially projecting vanes. When the drum mounted on the carrier frame is raised, a relatively large gap remains in the center of the ballast planing plow arrangement, which would lead to an undesirable accumulation of ballast remaining in the center track portion. Therefore, the arrangement cannot be used in practice without the drum. For all these reasons, such ballast regulators using rigid ballast conveying vanes have not been successfully used in track maintenance and rehabilitation work.

A similar ballast regulator has been disclosed in European patent application No. 164,160, published Dec. 11, 1985. In this machine, the ballast conveying drum with radially projecting iron vanes is rotatable about a vertical axis. The machine has substantially the same disadvantages.

SUMMARY OF THE INVENTION

It is the primary object of this invention to provide a mobile ballast regulator machine of the first-described type but which provides an improved distribution and shaping of the ballast.

The above and other objects are accomplished in accordance with the invention by associating a ballast conveying means with the center plow elements of the ballast planing plow arrangement, the ballast conveying means being arranged in the center track portion and consisting of at least one vertically adjustable broom rotatable about an axis extending in the direction of the track, the broom having radially extending flexible ballast sweeping elements, with respective drives for vertically adjusting and rotating the broom.

This combination of a generally conventional ballast planing plow arrangement with this type of central ballast conveying broom produces in a single operating stage not only proper ballast shaping by the plowshares but also improved ballast distribution by the central broom which conveys ballast from the center track portion laterally outwardly. This substantially enhances the efficiency and capacity of the ballast regulator. In addition, the ballast conveying broom may be readily retrofitted on existing ballast plowing machines. Furthermore, the ballast conveying broom is not part of the ballast planing plow arrangement and may be independently vertically adjusted in accordance with prevailing ballasting conditions. In this way, the ballast conveying broom may be set at different heights in dependence on the amount of ballast to be removed from the track center or it may be raised into an inoperative position in track sections where the cribs are more or less uniformly shaped and contain no undue ballast accumulations in the center.

DETAILED DESCRIPTION OF THE DRAWING

The above and other objects, advantages and features of the present invention will become more apparent from the following detailed description of certain now preferred embodiments thereof, taken in conjunction with the accompanying, generally schematic drawing wherein FIG. 1 is a side elevational view of a mobile ballast regulator according to one embodiment of this invention;

FIG. 3 is an enlarged section along line III—III of FIG. 2;

FIG. 4 is a reduced fragmentary end view of the center plow elements and associated ballast conveying brooms;

FIG. 5 is a diagrammatic top view showing the ballast distributing position of the ballast planing plow arrangement shown in FIG. 4, with two ballast conveying brooms preceding the arrangement in the operating direction, the brooms being staggered from each other transversely to the track as well as in the direction thereof;

FIGS. 6 to 8 are similar diagrammatic top views showing different ballast distributing positions; and FIG. 9 is a like top view showing a modified embodiment with a respective ballast conveying broom preceding and trailing the ballast planing plow arrangement.

DETAILED DESCRIPTION OF THE PREFERRED EMBODIMENTS

Figure 1:
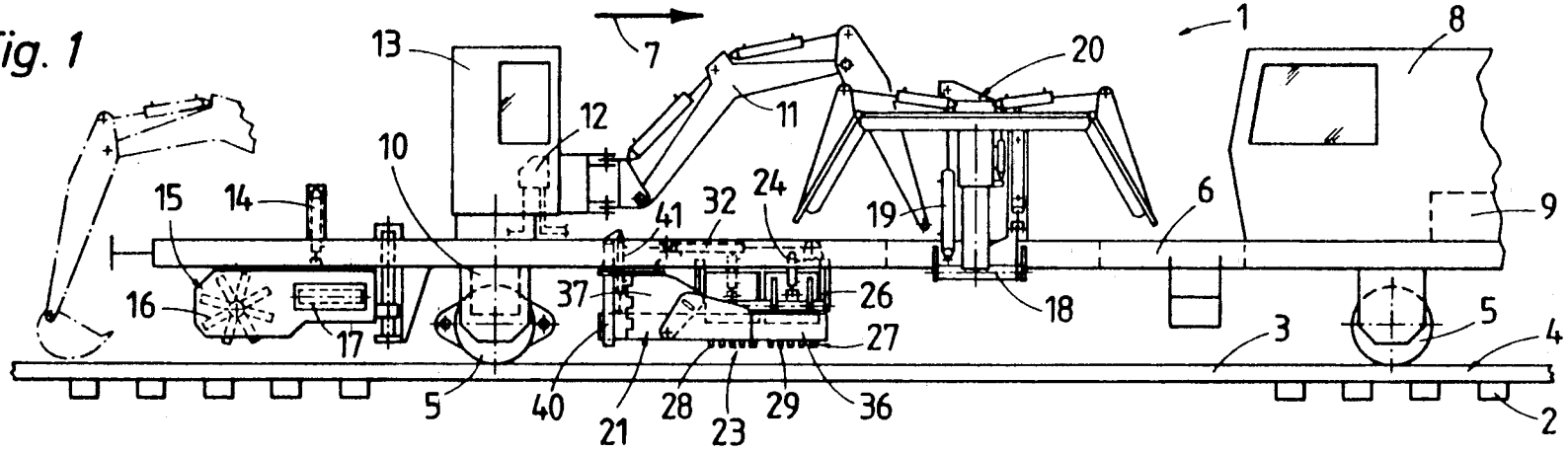
Figure 2:
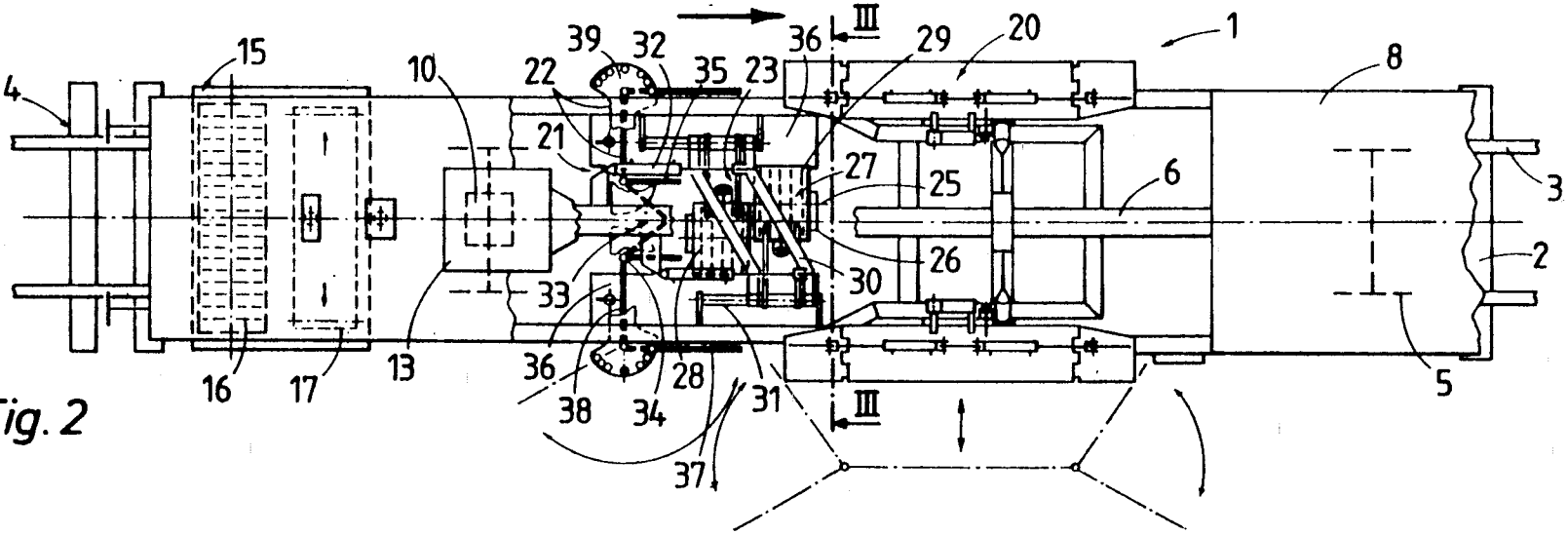
FIG. 2 is a top view of FIG. 1.

Referring now to the drawing and first to FIGS. 1 to 3, there is shown mobile ballast regulator machine 1 for distributing and shaping ballast of a ballast bed supporting track 4 consisting of two rails 3 fastened to ties 2, the two track rails defining center portion 33 of the track therebetween and respective shoulders supporting opposite ends of ties 2 at field sides of rails 3. The machine comprises machine frame 6 supported by undercarriages 5 for mobility along track 4 in an operating direction indicated by arrow 7. Drive 10 for moving machine frame 6 in this direction drives the wheels of rear undercarriages 5, and driver's cab 8 and power plant 9 are mounted on a forward end of the machine frame. The hereinafter described operating drives of the ballast regulator are hydraulic cylinder-piston drives in the illustrated embodiment, and the power plant accordingly comprises a hydraulic fluid supply. Operator's cab 13 with central control console 12 is mounted on machine frame 6 in the range of rear undercarriage 5 and is equipped with a vertically and longitudinally adjustable ballast excavator boom.

Ballast broom arrangement 15 is vertically adjustably mounted at a rear end of machine frame 6 and is vertically adjustable by drive 14. This arrangement comprises rotary ballast sweeping broom 16 rotatable about an axis extending transversely to the track to sweep ballast onto immediately preceding transverse ballast conveyor band 17 which conveys the swept ballast to a respective track shoulder.

Ballast planing plow arrangement 21 is vertically adjustably mounted on machine frame 6 between undercarriages 5 and extends from shoulder to shoulder. This arrangement includes center plow elements 22 extending over center track portion 33 between rails 3, and power drive 41 is arranged for vertically adjusting the ballast planing plow arrangement. According to the invention, ballast conveying means 23 is associated with the central plow elements and is arranged in the center track portion, and this ballast conveying means consists in the illustrated embodiment of two vertically adjustable brooms 27, 28 rotatable about axes 25 extending in the direction of the track. The brooms have radially extending flexible ballast sweeping elements. Respective drives 24, 26 are connected to each broom for independently vertically adjusting and rotating the connected broom on the machine frame. In the illustrated embodiment, the brooms immediately precede the central plow elements. The leading arrangement of the ballast conveying broom has the advantage of enhancing the transverse ballast flow initiated by the plowshares at one side of the track and to remove ballast from the center of the track towards the opposite side while the center plow elements properly shape the ballast in the cribs, thus improving the efficiency of the machine operation. In addition, since the brooms are simply and solidly mounted on the machine frame, and are independently vertically adjustable, the ballast planing plow arrangement and the ballast conveying brooms may be used each by themselves, if desired.

As best shown in FIG. 3, ballast conveying brooms 27, 28 have a diameter substantially corresponding to the height of central plow elements 22 in the illustrated embodiment. Brooms of such a dimension have a relatively great ballast conveying capacity for moving ballast from the center to a respective side of the track. Also, drives 26 for rotating ballast conveying brooms 27, 28 are arranged for selectively rotating the brooms in opposite directions. This enables the operation of the machine to be rapidly changed without interruption for redirecting the ballast flow from one side to the other so that ballast may be distributed toward either rail and shoulder, depending on the ballast conditions.

The illustrated ballast regulator comprises carrier frame 30 supporting ballast conveying brooms 27, 28 and drives 24, 26 for verically adjusting and rotating the brooms. The carrier frame is displaceably supported on guide beams 31 affixed to machine frame 6 by downwardly projecting carrier brackets 43 and extending in the direction of the track, and drive 32 is linked to the carrier frame for displacing the same along the guide beams. This enables the ballast conveying brooms to be longitudinally adjusted during the operation of the ballast regulator with respect to the ballast planing plow arrangement so that the brooms may be spaced farther therefrom in case of large ballast accumulations while they are moved closer thereto when there is relatively little ballast in the center track portion. In addition, proper spacing of the ballast conveying brooms from the ballast planing plow arrangement enables the center plow elements to be pivoted without interference by the brooms into respective operating positions. Each broom is housed in its own casing 44 which is connected to a pivotal frame 45 longitudinally displaceably mounted on one end therefo on a respective guide beam 31 while its opposite end is connected with the piston rod of a respective drive 24 for vertically adjusting each broom independently. Since the carrier frame supports two ballast conveying brooms, which precede center plow elements 22 and which are staggered from each other in the operating direction and whose axes are staggered from each other in a direction transverse to track 4, each of the brooms having its own rotating drive 26, the capacity of the machine is considerably since the brooms cover a large area in the center of the track while the independent rotating drives enable the brooms to be rotated in opposite directions so that accumulated ballast may be conveyed from the center to each side of the track or in the same direction to move all the ballast to one side. If relatively little ballast is present, only one of the brooms may be rotated. The longitudinally staggered arrangement of the brooms assures an uninterrupted flow of ballast over the combined length of the two brooms for a particularly effective removal of excess ballast from the center track portion. The independent vertical adjustment drives 24 enable the brooms to be independently set at various operating heights or into an inoperative position by remote control.

As shown in the drawing, the central plow elements of ballast planing plow arrangement 21 comprise two plowshares 35 pivotal about respective vertical axes 34 between a V-shaped plowing position permitting no ballast to flow between the plowshares (shown in broken lines in FIG. 2) and an open plow position (shown in full lines in FIG. 2). As will become more apparent from the following description of FIGS. 5 to 9, this center plowshare arrangement, particularly in combination with the preceding ballast conveying broom, makes it possible to adjust the ballast regulator to a great variety of ballasting conditions for distribution of excess ballast from any area of the ballast bed to areas where more ballast is needed.

Illustrated ballast planing plow arrangement 21 further comprises respective plowshare 38 having one end connected to each pivotal plowshare 35 at each vertical axis 34 and extending in a direction transverse to track 4. Tunnel-shaped element 36 covering each rail 3 is affixed to each transverse plowshare 38 and side plowshare 37 is connected to each transverse plowshare 38 at an end thereof opposite to the one end. A pivotal shoulder plow 20 is associated with each side plowshare 37 and is pivoted to each side of machine frame 6 for pivoting about axis 18 extending in the direction of the track and may be pivoted by drive 19 between a raised, inoperative position (shown in FIG. 1) and a lower, operative position for cooperation with the ballast planing plow arrangement, as shown in FIGS. 5 to 9. The tunnel-shaped rail covering elements will prevent any undesirable placing of ballast conveyed towards the rails by brooms 27, 28 on the rail fastening elements or the rails, which may interfere with the ballast plowing work and/or the forward movement of the machine along the track. Substantially horizontal covering plate 39 is affixed to an upper edge of each transverse plowshare 38 and projects towards preceding ballast conveying brooms 27, 28 over center position 33 of the track. This covering plate not only braces the center plowshares but also prevents ballast from overflowing them where a considerable amount of ballast is dammed in front of the center plowshares. Covering plate 39 has arcuately arrayed holes in the area where side and transverse plowshares 37, 38 are hinged together, and fixing bolts may be inserted into respective ones of these holes to hold the plowshares in respective pivoted positions so that the plowshares may enclose a desired angle. As shown in FIG. 1, the entire ballast planing plow arrangement is vertically displaceably mounted in guides 40 affixed to machine frame 6 and is vertically adjustable by drives 41. It extends from one side of the machine frame to the opposite side and reaches to the opposite ends of ties 2.

Each ballast conveying broom 27, 28 with its rotating drive 26 is indenpendently vertically adjustable by drive 24 affixed to longitudinally displaceable carrier frame 30. The ballast conveying brooms are thus displaceable in the operating direction into a forward position wherein the leading end of broom 27 extends to the leading ends of tunnel-shaped rail covering elements 36. In this way, the brooms will always be positioned between the tunnel-shaped rail covering elements so that any ballast conveyed towards the rails by the brooms will be prevented from lodging on the rails or the rail fastening elements. Guide rollers 42 support each tunnel-shaped rail covering element 36 on a respective rail.

Ballast regulator machine 1 operates in the following manner, as will be explained in more detail in connection with FIGS. 4 to 8.

While ballast planing plow arrangement 21, ballast conveying brooms 27, 28 and shoulder plows 20 are raised into their inoperative positions shown in FIG. 1, ballast regulator machine 1 is moved along the track to the operating site. Drives 41 and 24 are then actuated to lower the ballast planing plow arrangement and the ballast conveying brooms into their operative position in which guide rollers 42 support the ballast planing plow arrangement on track 4. Center plowshares 35 are then pivoted into their desired operating positions by pivoting drives 46 which are shown only in FIGS. 4 and 5, for clarity's sake. In the operating position illustrated in these figures, plowshares 35 are pivoted in a position wherein they extend substantially parallel to each other and to transverse plowshares 38 so that these plowshares form a dam extending transversely to the track. The left side plowshares 37, as seen in the operating direction indicated by arrow 7, is forwardly pivoted and held in this angular position by inserting a bolt into a respective hole in covering plate 39. The opposite side plowshare 37 is rearwardly pivoted, with respect to the operating direction, and also retained in this position by a bolt. The left shoulder plow 20 is then lowered into contact with the track shoulder ballast while the opposite shoulder plow is retained in its inoperative position. Only rear broom 28 is lowered into its operating position and rotated in the direction indicated by a small arrow. Rear ballast broom arrangement 15 is also lowered into its operating position by actuating drive 14.

Drive 10 is now actuated to propel machine 1 continuously along track 4 in the direction of arrow 7 to distribute and shape the ballast which is thus distributed in the manner shown by a long arrow in FIG. 5 from the left shoulder to the right shoulder, rotating broom 28 conveying the ballast in the center track portion in this transverse direction to prevent jamming of the flowing ballast in the center of the track. To adapt to different ballast amounts encountered along the track, drive 32 may be actuated without interruption of the operation to change the spacing of ballast conveying broom 28 from center plowshares 35 and/or second ballast conveying broom 27 may be lowered into its operating position.

In the operating position shown in FIG. 6, center plowshares 35 are pivoted into a V-shaped configuration, which is advantageous for the plowing of large amounts of ballast, particularly at the beginning of the operation, to assure a better ballast flow to the respective sides of the track. Both ballast conveying brooms 27, 28 are operated and rotated in the same direction, as indicated by small arrows, to distribute ballast from the left shoulder and from the track center to the right shoulder while, at the same time, pushing ballast towards the two ballast strips at the rails where the ties support the track rails on the ballast bed. The brooms will relieve pressure on center and transverse plowshares 35, 38 on the right side as they convey the redistributed ballast towards the right rail and over its tunnel-shaped covering element 36. As indicated in broken lines, side plowshares 37 and right shoulder plow 20 may be so positioned that the ballast flow is reversed from right-to-left. In either case, ballast planing plow arrangement 21 extends from shoulder to shoulder.

FIG. 7 illustrates a plow positioning best suited for a track section with relatively little ballast. In this case, the two ballast conveying brooms are rotated in opposite directions to convey any available ballast from the center of the cribs towards the two rails. At the same time, the two forwardly pivoted side plowshares 37 and both shoulder plows 20 will move ballast from the shoulders towards the rails. The two center plowshares 35 are pivoted by drives 46 about vertical axes 34 into a position extending parallel to the track rails whereby they provide a dam for ballast accumulated in front of transverse plowshares 38 and prevent the ballast from returning to the center of the track which has been swept by brooms 27, 28. As in the previously described operating positions, the drives for the adjustment of all the plowshares and of the ballast conveying brooms, as well as the shoulder plows, may be remote-controlled by central control console 12 without interrupting the forward movement of machine 1.

The position illustrated in FIG. 8 is most useful when an excessive amount of ballast has to be distributed from the track to its shoulders. The two center plowshares 35 are pivoted into the V-configuration and the two side plowshares 37 are rearwardly pivoted, with respect to the operating direction, while the two ballast conveying brooms are rotated in opposite directions. This will cause excess ballast to be moved from the center towards both shoulders over tunnel-shaped rail covering elements 36 and backwards along obliquely set plowshares 37 while the two ballast conveying brooms 27, 28 will relieve the pressure on center plowshares 35.

The modified embodiment of ballast planing plow arrangement 47 and ballast conveying brooms 54, 55 respectively preceding and trailing the ballast planing plow arrangement is useful in a machine of the same type, as shown in FIGS. 1 to 3, but capable of operating in opposite directions along the track. This ballast planing plow arrangement also has transverse, side and center plowshares 48, 49, 50, transverse plowshares 48 being affixed to respective tunnel-shaped elements 51 covering rails 57 and side plowshares 49 and center plowshares 50 being hinged to each other for pivoting about vertical axes. One end of center plowshares 50 is mounted on associated transverse plowshare 48 for displacement in a direction extending transversely to the track. In this way, the center plowshares are pivotal from a position extending transversely to the track into a V-shaped plowing position shown in chain-dotted lines. As illustrated, the apex of the V-configuration may point in the operating direction indicated by arrow 53 or in the opposite direction so that the machine may be operated in either direction. For this purpose, a respective ballast conveying broom 54, 55 is arranged immediately ahead and behind center plowshares 50 for cooperation with the ballast planing plow arrangement in a respective operating direction. The brooms have the same structure as ballast conveying brooms 27, 28 and may be operated in the same manner. Vertically adjustable shoulder plows 56 are associated with side plowshares 49.

This modified embodiment may be operated in the same manner as the first-described embodiment in a variety of operating positions of the plowing elements, with or without the ballast conveying broom, but it is operative in opposite operating directions.

What is claimed is:

1. A mobile machine for distributing and shaping ballast of a ballast bed supporting a track consisting of two rails fastened to ties, the two track rails defining a center portion of the track therebetween and respective shoulders supporting opposite ends of the ties at field sides of the trails, which comprises (a) a machine frame supported by undercarriages for mobility along the track in an operating direction, (b) a drive for moving the machine frame in said direction, (c) an operator's cab on the machine frame, (d) a ballast planing plow arrangement vertically adjustably mounted on the machine frame between the undercarriages and extending from shoulder to shoulder, the ballast planing plow arrangement including (1) central plow elements extending over the center track portion and including plow means causing ballast accumulations in the center track portion when the machine frame is moved in the operating direction and the plow arrangement is vertically adjusted to engage the ballast, (e) a power drive for vertically adjusting the ballast planing plow arrangement, and (f) a ballast conveying means, associated with the central plow elements immediately adjacent thereto and arranged in the center track portion between the undercarriages immediately preceding the central plow elements in the operating direction, for enhancing a transverse ballast flow from one shoulder of the track towards the opposite shoulder and to remove ballast from the center of the track towards the opposite shoulder while the center plow elements properly shape the ballast in the central track portion, the ballast conveying means comprising (1) at least one vertically adjustable broom rotatable about an axis extending in the direction of the track, the broom having radially extending flexible ballast sweeping elemetns including means for conveying ballast accumulated by the central plow elements from the center track portion towards a respective one of the rails upon rotation of the broom, and (2) respective drives for vertically adjusting and rotating the broom.

2. The mobile ballast distributing and shaping machine of claim 1, wherein the ballast conveying means is independently vertically adjustably arranged on the machine frame.

3. The mobile ballast distributing and shaping machine of claim 2, wherein the ballast conveying broom has a diameter substantially corresponding to the height of the central plow elements.

4. The mobile ballast distributing and shaping machine of claim 2, wherein the drive for rotating the ballast conveying broom is arranged for selelctively rotating the broom in opposite directions.

5. The mobile ballast distributing and shaping machine of claim 1, wherein at least two of said ballast conveying brooms rotatable about an axis extending in the direction of the track precede the central plow elements in the operating direction and are staggered from each other in said direction, each of said brooms having a drive for rotating the broom.

6. The mobile ballast distributing and shaping machine of claim 5, wherein the axes of the ballast conveying brooms are staggered from each other in a direction transverse to the track.

7. The mobile ballast distributing and shaping machine of claim 1, wherein the central plow elements comprise two plowshares pivotal about respective vertical axes between a V-shaped flowing position permitting no ballast to flow between the plowshares and an open plow position.

8. The mobile ballast distributing and shaping machine of claim 7, wherein the ballast planing plow arrangement further comprises a respective plowshare having one end connected to each pivotal plowshare at each vertical axis and extending in a direction transverse to the track, a tunnel-shaped element covering each rail affixed to each transverse plowshare, and a side plowshare connected to each transverse plowshare at an end thereof opposite to the one end.

9. The mobile ballast distributing and shaping machine of claim 8, wherein the ballast conveying broom has a leading end in the operating direction and is displaceable relative to the plow arrangement in said direction into a forward end position wherein the leading end of the broom extends to the leading ends of the tunnel-shaped rail covering elements.

10. The mobile ballast distributing and shaping machine of claim 9, wherein the ballast planing plow arrangement further comprises guide rollers supporting each tunnel-shaped rail covering element on a respective one of the rails.

11. The mobile ballast distributing and shaping machine of claim 8, further comprising a pivotal shoulder plow associated with each side plowshare.

12. The mobile ballast distributing and shaping machine of claim 8, wherein the ballast planing plow arrangement further comprises a substantially horizontal covering plate affixed to upper edges of the transverse plowshares and projecting towards the preceding ballast conveying broom over the center portion of the track.

13. A mobile machine for distributing and shaping ballast of a ballast bed supporting a track consisting of two rails fastened to ties, the two track rails defining a center portion of the track therebetween and respective shoulders supporting opposite ends of the ties at field sides of the rails, which comprises (a) a machine frame supported by undercarriages for mobility along the track in an operating direction, (b) a drive for moving the machine frame in said direction, (c) an operator's cab on the machine frame, (d) a ballast planing plow arrangement vertically adjustably mounted on the machine frame between the undercarriages and extending from shoulder to shoulder, the ballast planing plow arrangement including (1) central plow elements extending over the center track portion, (e) a power drive for vertically adjusting the ballast planing plow arrangement, and (f) a ballast conveying means associated with the central plow elements immediately adjacent thereto and arranged in the center track portion between the undercarriages, the ballast conveying means comprising (1) at least one vertically adjustable broom rotatable about an axis ectending in the direction of the track, the broom having radially extending flexibel ballast sweeping elements, (2) respective drives for vertically adjusting and rotating the broom, (3) a carrier frame supporting the ballast conveying broom and the drives for vertically adjusting and rotating the broom, (4) guide beams affixed to the machine frame and extending in the direction of the track, the carrier frame being displaceably supported on the guide beams, and (5) a drive for displacing the carrier frame along the guide beams.

14. The mobile ballast distributing and shaping machine of claim 13, wherein the displaceable carrier frame supports at least two of said ballast coneying brooms, each of said brooms having a respective drive for vertically adjusting each broom independently.

* * * * *